US007790660B2

(12) United States Patent
Carey et al.

(10) Patent No.: US 7,790,660 B2
(45) Date of Patent: Sep. 7, 2010

(54) HIGH EFFICIENCY POLYALKYLENE GLYCOL LUBRICANTS FOR USE IN WORM GEARS

(75) Inventors: James Thomas Carey, Medford, NJ (US); David K. Prendergast, Chester, PA (US); Kevin J. Buzdygon, Wilmington, DE (US)

(73) Assignee: ExxonMobil Research and Engineering Company, Annandale, NJ (US)

( * ) Notice: Subject to any disclaimer, the term of this patent is extended or adjusted under 35 U.S.C. 154(b) by 588 days.

(21) Appl. No.: 11/045,755

(22) Filed: Jan. 28, 2005

(65) Prior Publication Data

US 2005/0181958 A1 Aug. 18, 2005

Related U.S. Application Data

(60) Provisional application No. 60/544,704, filed on Feb. 13, 2004.

(51) Int. Cl.

| | |
|---|---|
| ***C10M 129/70*** | (2006.01) |
| ***C10M 133/16*** | (2006.01) |
| ***C10M 133/44*** | (2006.01) |
| ***C10M 133/12*** | (2006.01) |

(52) U.S. Cl. ..... 508/478; 508/514; 508/283; 508/563

(58) Field of Classification Search ..... 508/478, 508/514, 563, 283

See application file for complete search history.

(56) References Cited

U.S. PATENT DOCUMENTS

| | | | | |
|---|---|---|---|---|
| 3,116,252 | A * | 12/1963 | Beretvas | 508/225 |
| 3,644,482 | A * | 2/1972 | Dexter et al. | 560/75 |
| 3,663,437 | A | 5/1972 | Moore et al. | 252/28 |
| 4,701,273 | A | 10/1987 | Brady et al. | 252/32.5 |
| 5,024,677 | A | 6/1991 | Wang et al. | 44/335 |
| 5,032,300 | A * | 7/1991 | O'Neil | 508/281 |
| 5,151,205 | A * | 9/1992 | Culpon, Jr. | 508/485 |
| 5,342,531 | A * | 8/1994 | Walters et al. | 508/272 |
| 5,578,557 | A | 11/1996 | Dougan et al. | 508/437 |
| 5,599,779 | A * | 2/1997 | Karol et al. | 508/283 |
| 5,714,442 | A * | 2/1998 | Wolf | 508/279 |
| 6,194,359 | B1 | 2/2001 | Beyer et al. | 508/279 |
| 2004/0259743 | A1 * | 12/2004 | Butke | 508/273 |

FOREIGN PATENT DOCUMENTS

| | | | |
|---|---|---|---|
| DE | 2806133 | | 8/1979 |
| EP | 0460317 | | 12/1991 |
| EP | 0667389 | | 8/1995 |
| EP | 0796908 | A1 | 9/1997 |
| EP | 1054052 | A2 | 11/2000 |
| EP | 1092788 | A2 | 4/2001 |
| GB | 2117787 | | 10/1983 |
| JP | 2000008068 | A * | 1/2000 |
| JP | 2000008068 | A | 1/2000 |
| WO | WO99/63027 | | 9/1999 |

OTHER PUBLICATIONS

Ulrich Mann, Synthetic Oils for Worm Gear Lubrication, 99FTM17, American Gear Manufacturers Association paper, 1999 [ISBN: 1-55589-755-X].

Ciba, IRGALUBE ML 605A, MSDS, Revision Nov. 22, 2001, pp. 1-6.

* cited by examiner

*Primary Examiner*—Glenn Caldarola
*Assistant Examiner*—Jim Goloboy

(57) ABSTRACT

A polyalkylene glycol based lubricant composition that contains specified rust inhibitors and antioxidants has lowered operating temperature and is particularly suitable for use in worm drive gearboxes. The rust inhibitors consist of an N-acylo arcosine and an imidizole while the antioxidant consists of an alkylated diphenyl amine and a hindered phenol.

6 Claims, 1 Drawing Sheet

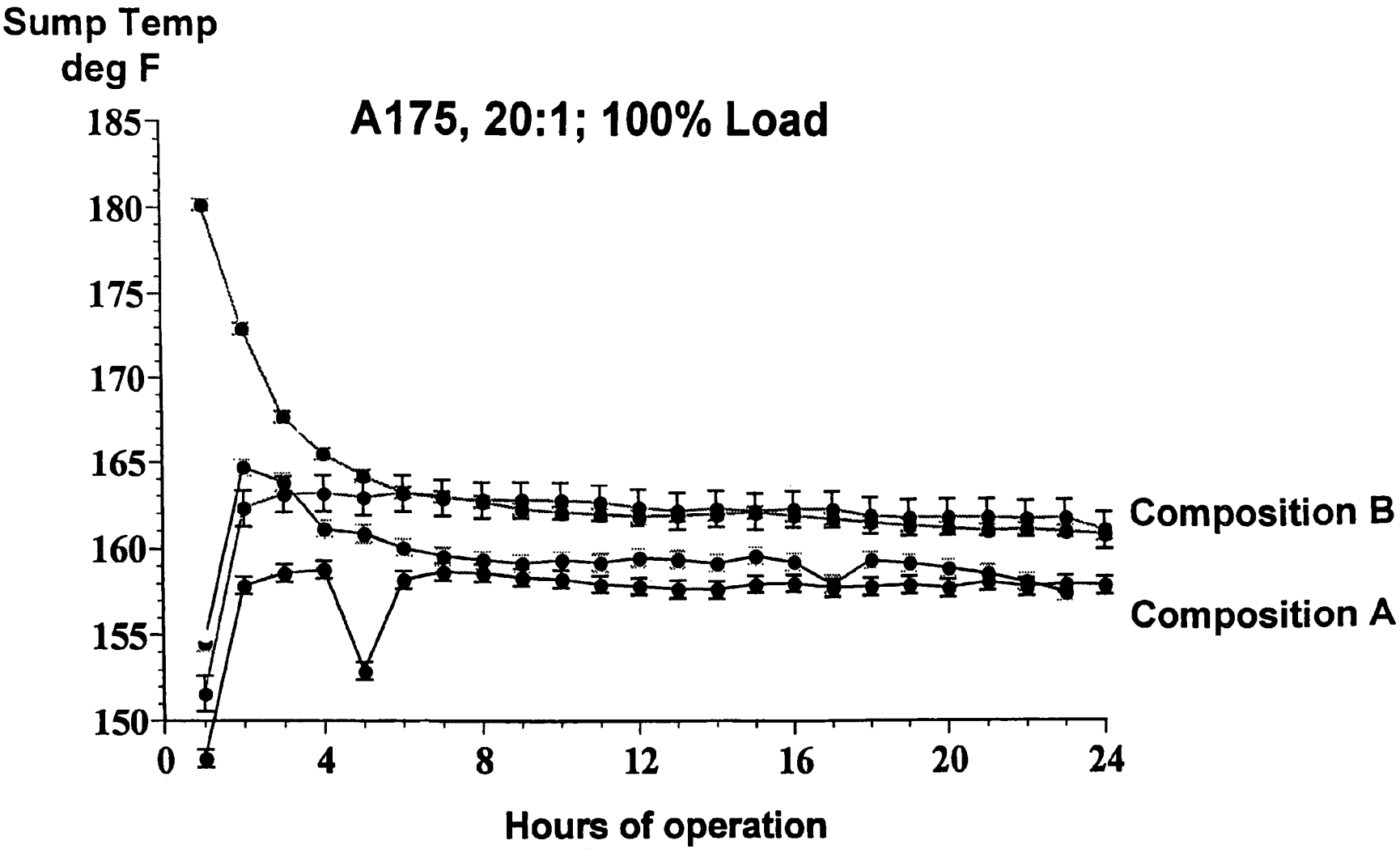
A175, 20:1; 100% Load
Sump Temp
deg F
185
180
175
170
165
160
155
150
0
4
8
12
16
20
24
Hours of operation
Composition B
Composition A

HIGH EFFICIENCY POLYALKYLENE GLYCOL LUBRICANTS FOR USE IN WORM GEARS

This application claims the benefit of U.S. Ser. No. 60/544,704 filed Feb. 13, 2004.

FIELD OF INVENTION

The present invention relates generally to polyalkylene glycol (PAG) lubricants and specifically to improved food grade lubricants suitable for use in worm drive gearboxes and other mechanical devices where improved efficiency and lowered operating temperatures are desirable.

BACKGROUND OF INVENTION

As is well known, commercially available lubricant compositions are prepared from a variety of natural or synthetic base stocks or blends of base stocks combined with various additive packages and solvents depending upon their intended application. For example, polyalkylene glycol (PAG) fluids have found use as the base oil in gearbox lubricants because of their better oxidation stability at high temperature when compared to mineral lubricating oils. Notwithstanding the oxidation stability of polyalkylene glycols, lubricating compositions based on these fluids are formulated with various additives such as antioxidants, corrosion inhibitors and the like to provide enhanced performance of the lubricating composition.

Formulating lubricating compositions to meet ever more stringent requirements is quite complex because of the potential interactions that may occur between the various additives that may be employed. Indeed, experience has shown that incorporation of one type of additive in a lubricant composition can have a negative impact on the function of another type of additive in that composition. For example, the presence of antiwear additives in a lubricant often reduces the oxidation stability of the formulation compared to one in which the antiwear additive is absent. Because oxidative degradation of oils increases with increasing temperature there is a need for lubricating composition that possess lowered oil temperatures under conditions of use.

Thus, one object of the present invention is to provide lubricating composition having lowered oil temperatures under conditions of use.

Another object of the invention is to provide a high efficiency polyalkylene glycol based oil composition for use in worm gears.

Yet another object of the invention is to provide food grade lubricants, i.e., lubricant compositions composed of components that are approved by U.S. DEPARTMENT OF AGRICULTURE or the National Sanitary Foundation (NSF).

SUMMARY OF INVENTION

According to one embodiment of the invention a lubricant composition comprises a major amount of a polyalkylene glycol base oil and:

(a) a minor amount of a rust inhibiting composition consisting of (i) a N-acylsarcosine of the formula

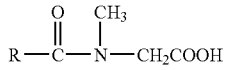

where R is an alkyl or alkenyl group of from about 10 to about 30 carbon atoms; and (ii) an imidizole of the formula

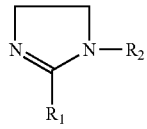

where $R_1$ is an alkyl or alkenyl group of from about 10 to about 30 carbon atoms and $R_2$ is a hydroxy alkyl group of from about 1 to about 6 carbon atoms; and (b) a minor amount of an antioxidant composition consisting of (iii) an alkylated diphenyl amine of the formula

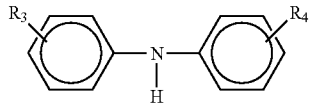

where $R_3$ and $R_4$ are independently alkyl groups of from about 2 to about 20 carbon atoms; and (iv) a hindered phenol of the formula

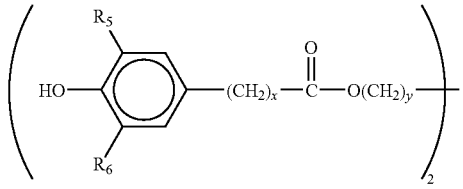

where $R_5$ and $R_6$ are independently alkyl groups of from about 3 to 9 carbon atoms, x is an integer of from 1 to about 4, and y is an integer of from about 1 to about 4.

A preferred lubricant composition includes an effective amount of a phenyl phosphosothioate antiwear additive and a tolyl triazole metal passivator.

Other aspects and embodiments of the invention will become apparent from the detailed description which follows.

BRIEF DESCRIPTION OF THE DRAWING

The accompanying FIGURE is a graph showing the sump oil temperature over time in a gearbox operated with a commercially available polyalkylene glycol (PAG) oil and with the lubricating oil composition of the invention.

DETAILED DESCRIPTION OF INVENTION

The composition of the invention comprises a major amount of a polyalkylene glycol fluid of lubricating viscosity.

Suitable polyalkeylene glycol fluids are copolymers of alkylene oxides. Especially suitable are copolymers of ethylene oxide and propylene oxide.

The kinematic viscosity of the fluids used typically will be in the range of about 50 cSt to about 3000 cSt at 40° C. depending, of course, upon the intended use of the ultimate composition. For example, for gearboxes the preferred kinematic viscosity of the fluid will be in the range of about 135 to about 1100 cSt at 40° C.

A single polyalkylene glycol fluid or a mixture of two or more polyalkylene glycol fluids may be used as the base oil in the invention composition to attain a desired viscosity.

The compositions also contain a minor amount of a rust inhibiting composition consisting of:

(i) a N-acylsarcosine of the formula

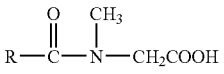

where R is an alkyl or alkenyl group of from about 10 to about 30 carbon atoms; and (ii) an imidizole of the formula

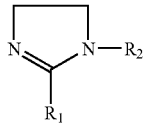

where $R_1$ is an alkyl or alkenyl group of from about 10 to about 30 carbon atoms and $R_2$ is a hydroxy alkyl group of from about 1 to about 6 carbon atoms.

In the practice of the invention it is preferred that the weight ratio of (i):(ii) will be in the range of 3:1 to 1:3 and more preferably 1:1. Also, it is preferred that $R_1$ is an alkenyl group of about 12 to about 20 carbon atoms and especially 18 carbon atoms, and that $R_2$ is a hydroxyl alkyl group having 2 carbon atoms.

The lubricating composition of the invention also includes a minor amount of an antioxidant composition consisting of:

(iii) an alkylated diphenyl amine of the formula

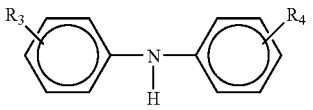

where $R_3$ and $R_4$ are independently alkyl groups of from about 2 to about 20 carbon atoms; and (iv) a hindered phenol of the formula

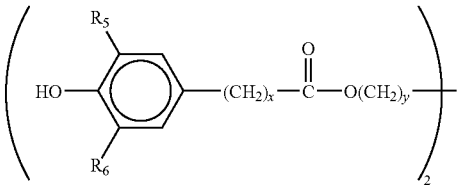

where $R_5$ and $R_6$ are independently alkyl groups of from about 3 to 9 carbon atoms, x is an integer of from 1 to about 4, and y is an integer of from about 1 to about 4.

The preferred weight ratio of (iii) to (iv) in the range of 3:1 to 1:3 and more preferably 1:1. Additionally it is preferred that $R_3$ and $R_4$ are alkyl groups of 4 to 8 carbon atoms, that $R_5$ and $R_6$ are tert butyl groups, that x is 2, and y is from 2 to 4 and especially 3.

As will be demonstrated hereinafter, lubricant additives may increase the operating temperature of a composition containing them. Consequently where operating temperatures are of particular concern such as in gearboxes, it is especially preferred that the compositions of the invention less than about 1.0 wt % of the rust inhibiting composition. For example, from about 0.40 to 0.80 wt % and less than about 2.0 wt % of the antioxidant composition, for example from about 0.50 to about 1.50 wt %, the wt % in all instances based on the total weight of the composition.

The lubricating composition of the present invention preferably will contain an effective amount of a phenyl phosphorothioate antiwear additive and a tolyltriazole metal passivator.

The phenyl phosphorothioate antiwear additive is represented by the formula:

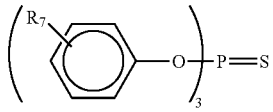

where $R_7$ is H or an alkyl group of from 1 to about 8 carbon atoms. Preferably $R_7$ is H. In general the amount of the antiwear additive will be in the range of about 0.1 to about 1.0 wt % based on the total weight of the lubricating composition.

The metal passivator may be represented by the formula:

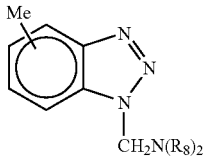

where $R_8$ is a branched alkyl group of from about 2 to about 20 carbon atoms and preferably is

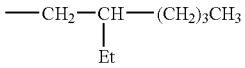

In general the amount of the metal passivator will be in the range of about 0.01 to about 0.50 wt % based on the total weight of the lubricating composition.

Other additives may be used as well such as colorants, antifoamants, dispersants and the like.

The compositions of the invention are particularly useful in gearboxes but may also be used in other mechanical devices where metal free lubricants are preferred. Examples include screw and reciprocating compressors, vane pumps, turbine support bearings and the like.

Also it will be appreciated that the base fluid and additives of the inventive compositions are used in amounts that meet standards set by the USDA and the NSF and hence may properly be considered to be food grade lubricants suitable for use where at least incidental contact with food for human consumption is possible.

The invention will be further illustrated by the following examples in which all the amounts in wt % are based on the total weight of the lubricating compositions.

The test rig used in the following examples was a worm drive gearbox having a 1.75 inch centerline distance and a 20:1 reduction ratio. The rig was operated at 100% rated load. The input power and torque as well as the output power and torque were monitored over a multi-hour test.

Example 1

The test rig described above was run with a polyalkylene glycol fluid formulated with antiwear, metal passivator and defoamant ("Base Lube") and the sump temperature of the oil was determined after equilibrium. At periodic intervals a rust inhibitor consisting of a mixture of equal parts by weight of Sarkosyl-O and Amine-O, a N-acyl sarcosine and an amine respective, sold by Ciba of Norwich, Conn. was added to the oil in four doses of 0.5 wt % until a total of 2.0 wt % was added. The sump temperature at equilibrium for each additive was determined. The results are given in Table 1.

TABLE 1

| Component | Concentration, wt % | Temperature, ° F. |
|---|---|---|
| Base Lube | 0.00 | 161.9 |
| Rust Inhibitor | 0.50 | 162.5 |
| Rust Inhibitor | 1.00 | 163.3 |
| Rust Inhibitor | 1.50 | 163.4 |
| Rust Inhibitor | 2.00 | 164.1 |

As can be seen, increasing amounts of the additive results in increased temperature.

Example 2

The procedure of Example 1 was followed except in this instance four doses of 1.0 wt % consisting of a mixture of equal parts by weight of Irganox L57, an alkylated diphenyl amine, and Irganox L109, an alkylated phenol sold by Ciba of Norwich, Conn. was used the results are shown in Table 2.

TABLE 2

| Component | Concentration, wt % | Temperature, ° F. |
|---|---|---|
| Base Lube | 0.00 | 161.9 |
| Antioxidant | 1.00 | 162.6 |
| Antioxidant | 2.00 | 163.1 |
| Antioxidant | 3.00 | 163.5 |
| Antioxidant | 4.00 | 164.6 |

As can be seen, increasing amounts of the additive results in increased temperature.

Example 3

Two lubricant compositions were tested using the test rig. Each of the compositions tested had a polyalkylene glycol base oil described above. In Composition A (according to the invention) the base oil was a mixture of 93 wt % Dow Synalox 40-D300I and 5 wt % Dow Synalox 40-D700, each sold by Dow Chemical Company, Houston, Tex. The formulation for Composition A is given in Table 3.

TABLE 3

| Component | Formulation | Amount, wt % |
|---|---|---|
| polyalkylene glycol | Base fluid | 98.00 |
| alkylated diphenyl amine | Antioxidant | 0.50 |
| hindered phenol | Antioxidant | 0.50 |
| N-acylsarcosine | Rust inhibitor | 0.15 |
| Imidazole | Rust inhibitor | 0.25 |
| phenyl phosphorothioate | antiwear additive | 0.50 |
| Tolyltriazole | metal passivator | 0.10 |
| silicone (1%) | Defoamant | 0.002 |

Composition B is a commercially available poly alkylene glycol based lubricant.

The results of the test (made in duplicate) are shown graphically in the accompanying FIGURE. As can be seen after equilibrium the composition of the invention, Composition A, had a lower sump operating temperature (158° F.) when compared to the temperature (162° F.) of the commercially available lube, Composition B.

What is claimed is:

1. A lubricant composition suitable for use in gearboxes comprising:

a major amount of a base oil consisting of polyalkylene glycol fluid or a mixture of polyalkylene glycol fluids, and based on the total weight of the composition;

(a) from 0.1 to 1.0 wt % of an rust inhibitor composition consisting of:

(i) a N-acylsarcosine of the formula

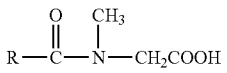

where R is an alkyl or alkenyl group of from about 10 to about 30 carbon atoms; and (ii) an imidizole of the formula

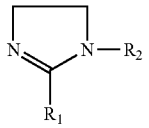

where $R_1$ is an alkyl or alkenyl group of from about 10 to about 30 carbon atoms and $R_2$ is a hydroxy alkyl group of from about 1 to about 6 carbon atoms; and (b) from 0.1 to 2.0 wt % of a antioxidant consisting of:

(iii) an alkylated diphenyl amine of the formula

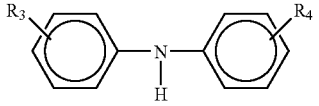

where $R_3$ and $R_4$ are independently alkyl groups of from about 2 to about 20 carbon atoms; and (iv) a hindered phenol of the formula

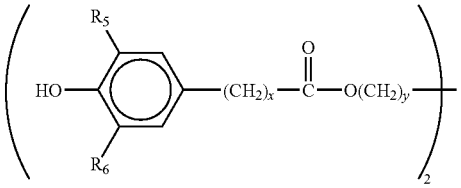

where $R_5$ and $R_6$ are independently alkyl groups of from about 3 to 9 carbon atoms, x is an integer of from 1 to about 4, and y is an integer of from about 1 to about 4;

(c) a silicon defoamant.

2. The composition of claim 1 including an effective amount of a phenyl phosphorothioate antiwear additive and a tolyl triazole metal passivator.

3. The composition of claim 1 wherein the polyalkylene glycol has a viscosity in the range of about 50 to about 3000 cSt at 40° C.

4. The composition of claim 1 wherein the weight ratio of (i):(ii) is in the range of 3:1 to 1:3.

5. The composition of claim 1 wherein the base oil is a mixture of polyalkylene glycol fluids.

6. The composition of claim 1 wherein the weight ratio of (iii):(iv) is in the range of 3:1 to 1:3.

* * * * *